US005543775A

United States Patent [19]

Huck

[11] Patent Number: 5,543,775

[45] Date of Patent: Aug. 6, 1996

[54] THIN-FILM MEASUREMENT RESISTOR AND PROCESS FOR PRODUCING SAME

[75] Inventor: Ralf Huck, Hanau, Germany

[73] Assignee: Mannesmann Aktiengesellschaft, Dusseldorf, Germany

[21] Appl. No.: 205,201

[22] Filed: Mar. 3, 1994

[51] Int. Cl.[6] ..... H01C 1/012

[52] U.S. Cl. ..... 338/306; 338/314; 29/851; 174/256

[58] Field of Search ..... 338/25, 306, 307, 338/308, 309, 314; 174/256, 253, 258, 260; 361/765; 29/851, 860

[56] References Cited

U.S. PATENT DOCUMENTS

| | | | |
|---|---|---|---|
| H546 | 11/1988 | Schnable et al. | 419/7 |
| 3,845,443 | 10/1974 | Fischer | 338/25 |
| 4,139,833 | 2/1979 | Kirsch | 338/308 |
| 4,227,039 | 10/1980 | Shibasaki et al. | 338/307 |

FOREIGN PATENT DOCUMENTS

| | | |
|---|---|---|
| 828930 | 1/1952 | Germany . |
| 3603785 | 2/1989 | Germany . |
| 3843746 | 7/1990 | Germany . |
| 9006967 | 12/1991 | Germany . |

OTHER PUBLICATIONS

Copy of article titled: "*Sensorenherstellung mit Dünnschichttechnik*" (Bd. 40 (1987)Heft 7) by Jörg Müller (3 p.).

Copy of article titled: "*Dünn—und Dickschichttechnologien für die Sensorik*" (Bd. 109 (1988) Heft 11) by Jörg Müller (5 p.).

*Primary Examiner*—Tu Hoang

*Attorney, Agent, or Firm*—Cohen, Pontani, Lieberman, Pavane

[57] ABSTRACT

A process for producing a thin-film measurement resistor in which an electrically insulating work material with a low specific heat capacity serves as substrate material, a metal film, preferably platinum, being applied thereto. The lateral electrical resistor is then structured and trimmed by erosive after-treatment, and the metal film is passivated in a final process step. The resistor element reacts more quickly to changes in temperature, the cover layer is extremely resistant to corrosion, and the entire construction is simple to produce in that glass is used as a substrate material and is provided, before applying the metal film, with a bonding agent layer of $Al_2O_3$ which is substantially thinner than the metal film. The metal film is then applied by evaporation and structured by sputter etching. Finally, the metal film is provided with a protective coat of $SiO_x$.

10 Claims, 1 Drawing Sheet

THIN-FILM MEASUREMENT RESISTOR AND PROCESS FOR PRODUCING SAME

BACKGROUND OF THE INVENTION

1. Field of the Invention

The invention relates generally to thin-film sensing devices, and more particularly to a thin-film resistive element and methods for fabricating the same.

An arrangement formed from two thin-film measurement resisters is used for the construction of a so-called hot-film anemometer. One of the thin-film measurement resisters works as a resistance heating element, while the other works as a temperature sensor. These resisters are formed from a thin structured metal film which is applied to a substrate with poor thermal conductivity, i.e. one characterized by a low specific heat capacity. The substrate is often made of glass and, in many cases, ceramic material. The problems associated with the use of ceramics arise in that the surface quality of the ceramic must be such that metal films can be applied homogeneously in the range of one micrometer or less in the first place. Such surface conditions are often not provided. The metal film forming the actual resistance element is generally made of platinum. However, the metal film, once applied, must be treated or structured in a suitable manner. This after-treatment is effected by erosion, i.e. removal of material, and the film resistor must first be structured and then trimmed. It is known from DE-PS 38 43 746 to provide the metal film with a meandering structure. Depending on the way in which such resistor elements are used in hot-film anemometers, a resistance to the process medium to be measured must be achieved in addition to the electrical and thermal characteristic. For this purpose, oxide or nitride films are conventionally provided for passivation. As a rule, this is effected by chemical vapor deposition with plasma enhancement, as the case may be.

It is therefore an object of the present invention to provide a process for producing a thin-film measurement resistor and to provide a thin-film measurement resistor element which reacts more quickly to changes in temperature, which is simple and economical to manufacture.

It is a further object of the present invention to provide a resistor element having a cover layer which is extremely resistant to corrosion.

SUMMARY OF THE INVENTION

The aforementioned objects, as well as others which will become apparent to those skilled in the art, are achieved by a process in which an electrically insulating work material with a low specific heat capacity serves as substrate material, a metal film, preferably platinum, being applied thereto, and the lateral electrical resistor to be achieved is then patterned, defined, and the film is passivated in a final process step. Glass is used as a substrate material and is provided before the application of the metal film with a bonding agent layer of $Al_2O_3$ which is substantially thinner than the metal film. The metal film is then applied by vapor deposition and defined sputter etching. The metal film is then provided with a protective coat of $SiO_x$. In an alternate embodiment of the present invention, a ceramic material forms the substrate and the metal film is applied directly to the substrate material. Thus, the processes according to the invention alternatively provide for the use of glass or ceramic as substrate material, depending on whether or not a bonding agent layer must be provided. If the substrate material is made of ceramic, preferably $Al_2O_3$ ceramic, the bonding agent layer may, of course, be dispensed with entirely given suitable surface conditions. In this case, the metal film can be applied directly. With either alternative, it is advantageous on the whole to apply the metal film by evaporation and structure it by means of sputter etching. This results in a metal film which is extremely homogeneous with respect to thickness. When structuring is effected by means of sputter etching rather than by conventional laser treatment, homogeneity is also obtained in the process step involving structuring of the metal film. Mounds which are sometimes thicker than the metal film itself are formed on the metal film in the conventional local thermal process of after-treatment by erosion. However, in the process according to the invention, such mounds can be entirely prevented by resorting to the evaporation technique for applying the metal film and structuring by means of sputter etching. The sputter etching is essentially carried out by means of classic dry etching in plasma. This metal film layer may be covered directly by a protective coat of silicon oxide $SiO_x$ due to the achieved homogeneity which is retained even after the structuring or treatment of the metal film. This means that precision trimming with a laser is not necessary and can be dispensed with before coating. It has been shown that $SiO_x$ in particular has an extremely favorable resistance to moisture, where x should be in the range of 1.0 to 1.9. In this case, the layer has a light- yellow to brown coloring at a thickness of 2 micrometers. Layers of higher stoichiometric proportions, where×is greater than 1.9, are more transparent and are less resistant to moisture.

A much greater resistance to corrosion by aggressive process media is achieved when the protective coat is applied in three steps: 1. coating; 2. washing; 3. coating. A protective coat applied according to these process steps is extremely resistant to corrosion. This effect can be explained as follows. In spite of the most meticulous precautions, the metal film may be charged with dirt particles before the application of the protective coat. Naturally, the dimensions of such dirt particles are considerable in relation to the thin layer thicknesses used, and they adhere poorly to the substrate material. In coating such a metal film, so-called pinholes are generally formed, i.e. the dirt particles are incorporated in the coating and the coating can open up in the region of the dirt particles because of their poor adhesion. The obvious step of washing the metal film prior to the first coating is also inadvisable. This must be avoided for technical reasons relating to coating and for physical reasons so as not to change the quality of the thin metal film. Rather, care must be taken in the process steps following the coating to prevent the intrusion of any unnecessary dirt particles during the process. Although dirt particles may be covered in the first coating step according to the invention, the coated surface is washed in a second process step so that additional dirt particles are virtually ruled out. This washing process must be carried out in such a way that the poorly adhering dirt particles coated in the first coating process flake off again. This may be effected by means of an ultrasonic bath for example. However, washing with a brush has proven particularly advantageous. This has the least influence on the adhesive strength of the metal film. In a final process step, another coating is applied. In this way, no pinholes can break through from the metal film to the last layer applied in the final process step. This could only occur if a first dirt particle present before the first coating and a second dirt particle present at the same location prior to the final coating step lay on top of one another. Since the probability of this occurrence is infinitesimal, the pinhole effect is ruled out. Practical experience bears this out.

The best protection against corrosion due to aggressive process media is achieved when the protective coat is applied in the manner described above in three steps, wherein the first coating is effected immediately following the application of the metal film, i.e. without the metal layers being removed from the vacuum. Of course, this type of coating requires a system with two evaporator sources. In this case, the metal layer and passivation are structured and washed by sputter etching. The second coat is applied subsequently. The favorable resistance to corrosion results in that no impurities affecting adhesion may occur between the metal layer and passivation. The second coating serves only to cover the edges of the metallization exposed by the sputter etching.

The thicknesses of the applied layers in the overall thin-film resistor arrangement are adapted to one another with respect to dimensions. If glass is used as substrate material, the bonding agent layer applied to the glass is made from $Al_2O_3$ with a thickness $d_h$ amounting to less than 5% of the metal film thickness $d_f$. This leads to very good temperature coefficients which are to be kept as high as possible. By limiting the thickness of the bonding agent layer, it can be ensured that the different expansion coefficients will not lead to cracking as a result of changes in temperature. The selected thickness $d_x$ of the protective coat amounting to at least 300% of the metal film thickness $d_f$ is the outcome of extensive testing with the guideline of providing the metal film directly with a passivating protective coat. In so doing, the above-mentioned effect of eliminating pinholes is taken into account.

BRIEF DESCRIPTION OF THE DRAWINGS

The features and advantages of the present invention will be more readily understood from the following detailed description when read in conjunction with the accompanying drawings, in which.

DETAILED DESCRIPTION OF THE INVENTION

Figure 1:
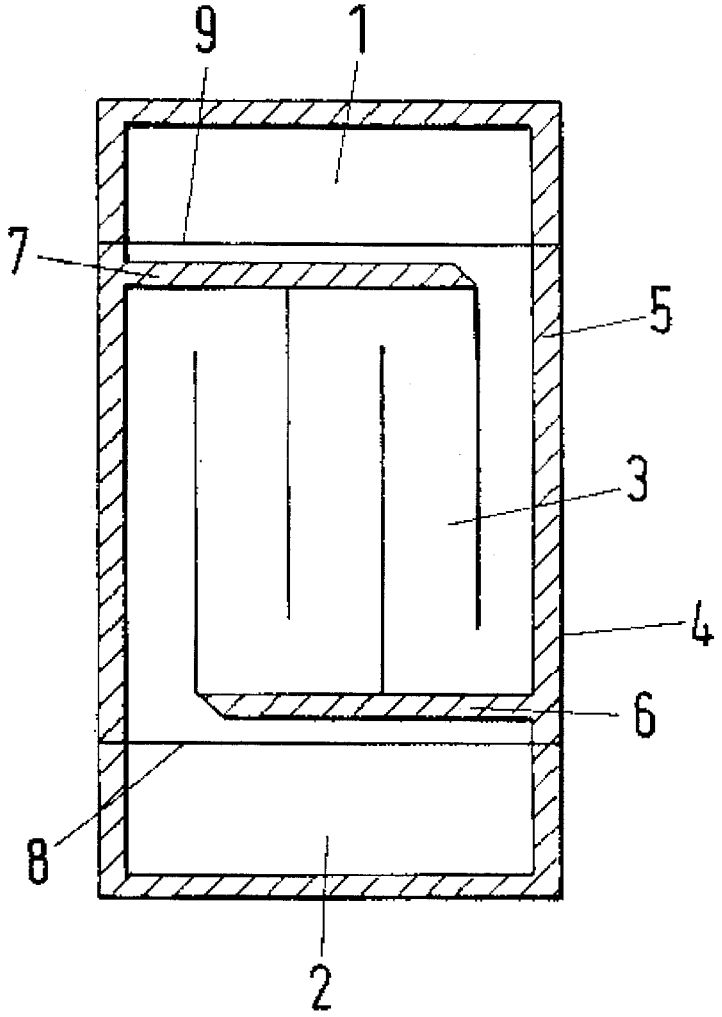
FIG. 1 shows a top view of a thin-film measurement resistor fabricated in accordance with the present invention.

FIG. 1 shows the thin-film measurement resistor produced according to the invention as seen from the top. A correspondingly structured platinum surface or platinum film is applied to the substrate 5. The hatched surfaces are free of platinum, i.e. the surface of the substrate is exposed in these locations. The actual measurement resistor is formed by a platinum film portion 3 with a meandering structure which merges in an electrically conductive manner with the platinum film portions 1 and 2 serving as connection surfaces. The actual meander portion 3 is insulated from the connection surfaces 1 and 2 via the insulating portions; that is, in the region of the insulating portions 6 and 7, the substrate surface is also free of platinum. When using glass as a substrate 5, the bonding agent is applied in a first step. In the following step, the platinum film layer is evaporated on and subsequently after-treated in a suitable manner to obtain the structure shown in the drawing. In the final process step, the applied cover layer or protective coat is applied not to the entire surface of the film resistor, but only in the region between the lines 8 and 9. This can be effected, for example, by subsequent covering with a photosensitive lacquer and partial chemical erosion of the uncovered locations. However, production is made simpler and, above all, more economical when the locations which are not to be coated are covered by a mask. The connection surfaces 1 and 2 accordingly remain free for contacting.

Combining the two techniques has proven advantageous when the metal layer and coating are to be applied in a single work step. The first coating is thinner than the second coating (approximately 1:2). The second coating is evaporated on through a diaphragm and provided with an additional protective coat of $Al_2O_3$ in one work step. The connection surfaces 1 and 2 can now be clearance-etched chemically in a simple manner, since the second coating is protected from the corrosive action of the etching medium by the $Al_2O_3$ protective coat.

As an alternative, the substrate 5 can also be made of ceramic. Naturally, the bonding agent layer is omitted in this case, wherein the ceramic substrate material is advisably $Al_2O_3$. The platinum resistance film 3, 1, 2 may be applied directly to the latter. After evaporating on the platinum film, appropriate structuring is carried out as defined above and a cover layer or protective coat is applied subsequently and extends between lines 8 and 9, leaving open the connection surfaces 1 and 2.

Figure 2:
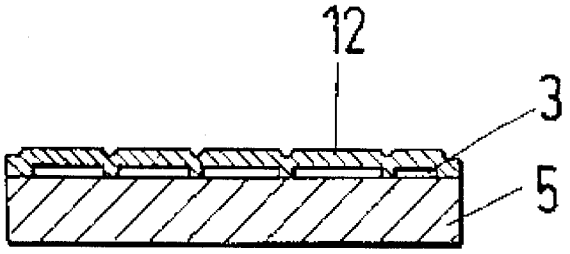
FIG. 2 shows an elevation view of the resistor depicted in FIG. 1.

FIG. 2 shows a frontal view of the thin-film measurement resistor. The substrate 5 is again shown as carrier with the measurement resistor 3 which is applied thereon, subsequently structured in meandering form, and covered by the passivating protective coat 12. This protective coat 12 which serves as passivation against aggressive process media extends between the lines 8 and 9 shown in FIG. 1.

Particularly favorable results are obtained when the thickness of the layer construction is dimensioned in the following manner. When a platinum film has a thickness of 1.2 micrometers with glass as substrate material, a bonding agent layer of $Al_2O_3$ with a thickness of 0.02 micrometers proves effective. Since the platinum layer is evaporated on and then structured by sputter etching, as already mentioned, the protective coat can be applied directly, i.e. without an intermediate layer. The protective coat has a thickness of up to approximately 2 micrometers of $SiO_x$. The final coating with the protective coat is effected by so-called thin film technique. In the present sense, thin film technique means that this process step is carried out in a vacuum by means of an evaporator source.

I claim:

1. A process for producing a thin-film resistive element, comprising the steps of:

providing a bonding agent layer of $Al_2O_3$ on a glass substrate;

depositing a metal film on said bonding agent layer;

forming at least one resistive path from said metal film; and coating said metal film with a protective layer of $SiO_x$ by applying a first oxide layer, washing a surface of the oxide layer, and applying a second oxide layer to the washed surface.

2. The process for producing a thin-film resistive element according to claim 1, wherein the $SiO_x$ protective layer has a stoichiometric index that is no more than 1.9.

3. The process for producing a thin-film resistive element according to claim 2, wherein the bonding agent layer and protective layer are applied by thin film deposition.

4. A process for producing a thin film resistive element, comprising the steps of:

depositing a metal film on a substrate of a dielectric ceramic material;

forming at least one resistive path from said metal film; and coating said metal film with a protective layer of $SiO_x$ by applying a first oxide layer, washing a surface of the oxide layer, and applying a second oxide layer to the washed surface.

5. The process for producing a thin-film resistive element according to claim 4, wherein the $SiO_x$ protective layer has a stoichiometric index that is no more than 1.9.

6. A thin-film resistive element for use in a sensing device, comprising:

a thin dielectric substrate of glass having disposed thereon a bonding agent layer of $Al_2O_3$;

a metal film disposed on said bonding agent layer and having a thickness, said bonding agent layer having a thickness of less than 5% of the metal film thickness; and a protective coating disposed on said metal film by application of a first oxide layer, washing of a surface of the oxide layer, and application of a second oxide layer to the washed surface, said protective coating having a thickness at least equal to the thickness of the metal film.

7. The thin-film resistive element according to claim 4, wherein the metal film is platinum.

8. The thin-film resistive element according to claim 4, wherein the bonding layer has a thickness of at least 0.02 microns.

9. The thin-film resistive element according to claim 4, wherein the protective coating has a thickness of up to 2 microns.

10. A thin-film resistive element for use in a sensing device, comprising:

a thin dielectric substrate of $Al_2O_3$;

a metal film disposed on said substrate and having a thickness; and a protective coat disposed on said metal film by application of a first oxide layer, washing of a surface of the oxide layer, and application of a second oxide layer to the washed surface, said protective coat having a thickness at least equal to the thickness of the metal film.

* * * * *